United States Patent [19]

Ambrose

[11] 4,133,538

[45] Jan. 9, 1979

[54] PYRAMID BUILDING GAME

[76] Inventor: David W. Ambrose, 10 Nordica Dr., Croton on Hudson, N.Y. 10520

[21] Appl. No.: 816,445

[22] Filed: Jul. 18, 1977

[51] Int. Cl.[2] ..... A63F 3/00; A63F 9/12

[52] U.S. Cl. ..... 273/276; 273/157 R; 273/287

[58] Field of Search ..... 273/241, 276, 282, 287, 273/157 R

[56] References Cited

U.S. PATENT DOCUMENTS

| | | | |
|---|---|---|---|
| 715,435 | 12/1902 | Lackner | 273/287 |
| 2,188,043 | 1/1940 | Harrison | 273/157 R X |
| 2,506,184 | 5/1950 | Twining | 273/276 |
| 3,484,108 | 12/1969 | Geiger | 273/282 |
| 3,649,018 | 3/1972 | Beam | 273/276 |
| 3,706,456 | 12/1972 | Sesti et al. | 273/276 |
| 3,817,531 | 6/1974 | King et al. | 273/276 |

OTHER PUBLICATIONS

Amsco Toy Catalog Illustration, received 3-10-66.

*Primary Examiner*—Anton O. Oechsle

*Attorney, Agent, or Firm*—Richard L. Miller

[57] ABSTRACT

A game which can be played by two or more players wherein each player receives an individual game set having a storage box containing three groups of building blocks, the blocks of each group being of the same configuration. The cover of the storage box serves as the gameboard for that player, and includes receptacles for holding one face of a regular pyramid structure having a square base. The building blocks are assembled on the gameboard to form the pyramid structure on the gameboard. The blocks of a first group are in a particular shape whereby, when positioned on the gameboard they each produce a four faced regular pyramid extending upwardly from the gameboard. The blocks of the second group are in the shape of a symmetrical octahedron having a bifurcated lateral edge defining a pair of angularly oriented faces that extend toward the central vertex. The blocks of the third group are in the shape of a four faced oblique pyramid having a parallelogram base. The building blocks within each storage box are distinguishingly identified from the other building blocks in other storage boxes.

7 Claims, 12 Drawing Figures

Fig. 1
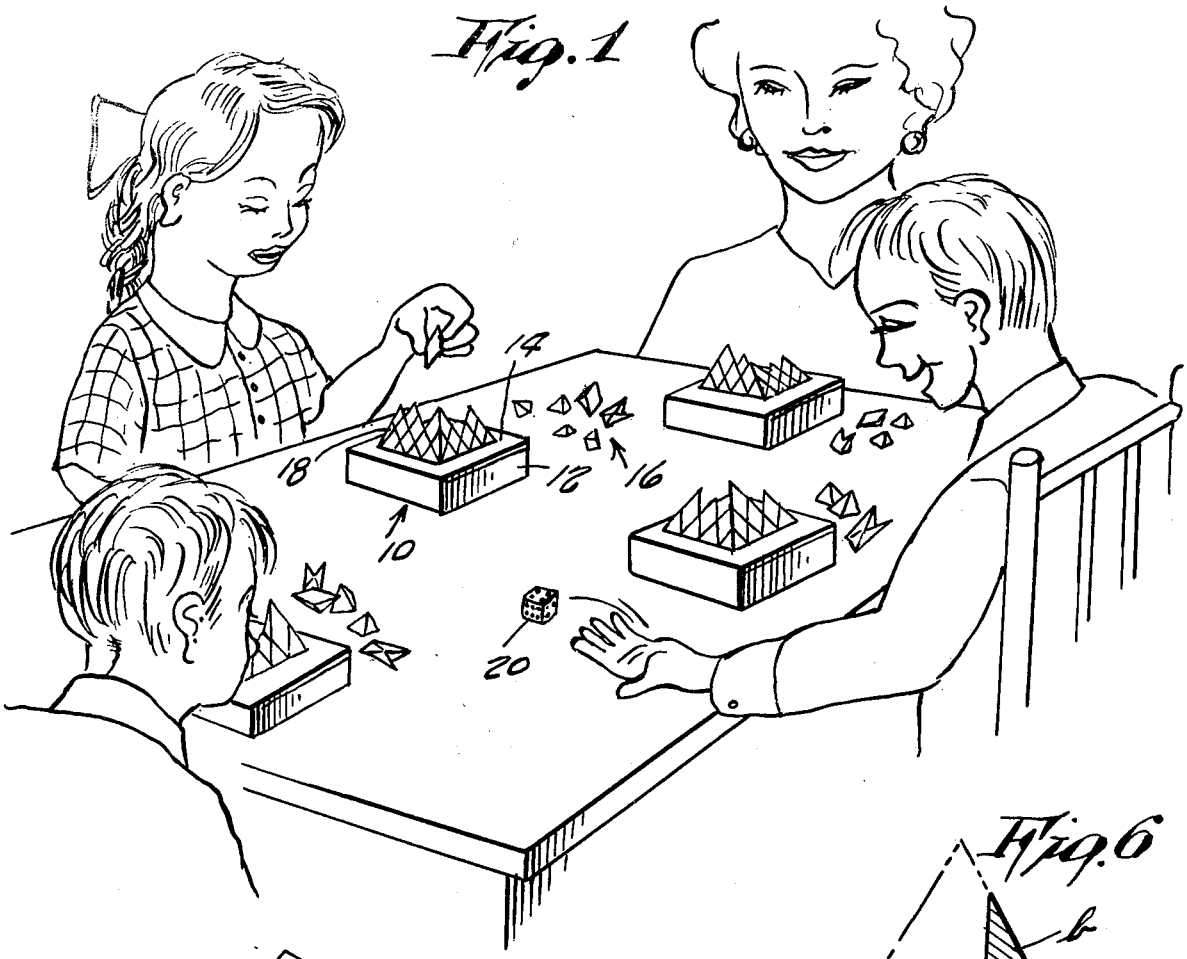
Fig. 6
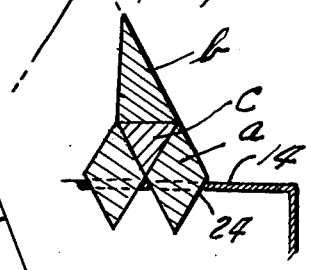
Fig. 2
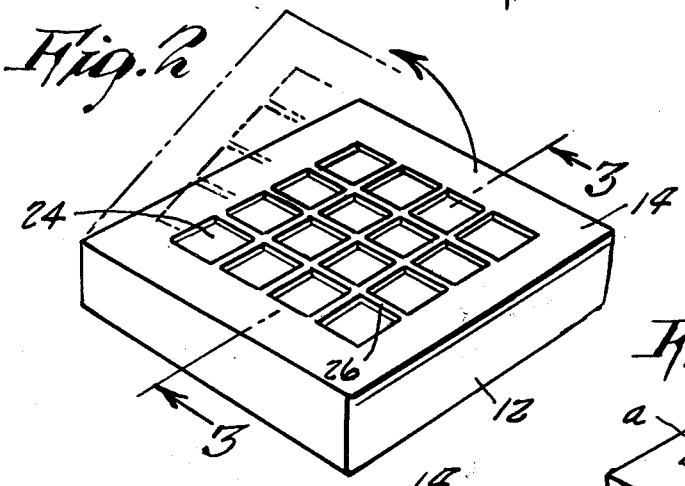
Fig. 4
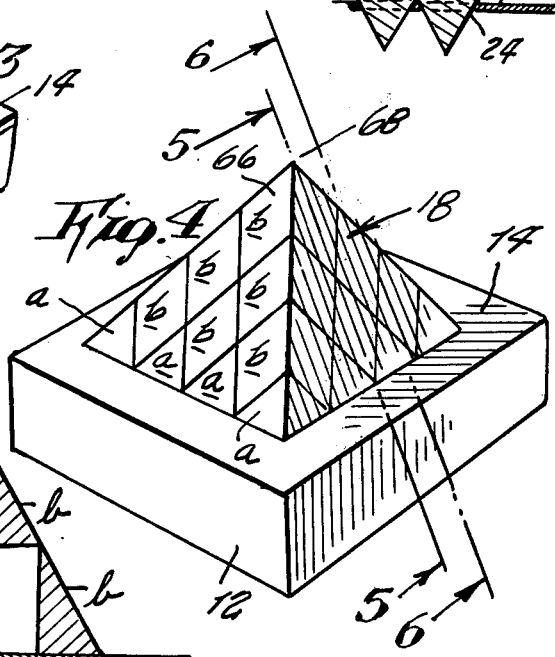
Fig. 3
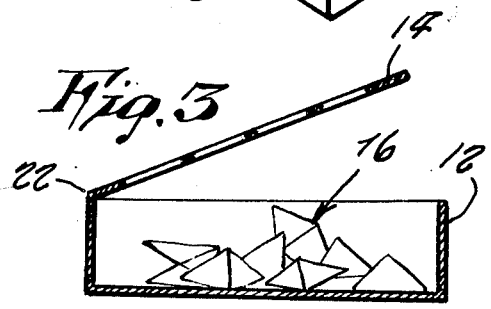
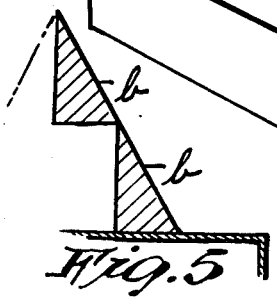
Fig. 5

PYRAMID BUILDING GAME

BACKGROUND OF THE INVENTION

This invention relates to a game and more particularly to a building block game wherein players compete to assemble a predesigned structure utilizing specified geometrically shaped building blocks.

Numerous games are presently available utilizing individual pieces or blocks to form a structure. Most of these games are games of skill or creativity, whereby blocks can be put together in any fashion to produce any desired structure. For example, some games include forms and shapes of blocks and pegs can be interconnected to form faciful structures depending upon the ingenuity and creativity of the players. Additionally, some games require only the skill of the player whereby a predetermined structure is to be completed by means of a fixed number of uniquely designed playing pieces. The complexity of assembling the playing pieces provides the challenge to the player.

However, heretofore little attention has been given to provide a building block game wherein players can compete with each other in an attempt to be the first to complete the predetermined structure. In such type of game, a balance must be made between skill and chance. On the one hand, a chance determining means is utilized whereby the amount of assembling permitted by each player during his turn is given to luck. At the same time, the skill of the player is needed to be able to put together the building blocks to achieve the total structure. However, the structure must be one that is simple enough to be assembled without difficulty, and yet complex enough to make the game challenging and interesting.

Furthermore, when trying to achieve a competitive game of building a predesigned structure, the structure must be one that can be attractive, easily recognizable, sturdy during its construction, as well as able to be assembled in small pieces utilizing predesigned geometric building blocks.

SUMMARY OF THE INVENTION

Accordingly, it is an object of the present invention to provide an improved game having for its purpose the competitive building of a predetermined structure.

Another object of the present invention is to provide a game wherein players compete to be the first to complete a predetermined structure utilizing a given set of building blocks.

Yet another object of the present invention is to provide a game where the players assemble predetermined blocks to achieve a desired structure, and which combines the elements of chance and skill.

Another object of the present invention is to provide a game wherein each player has his own gameboard, set of building blocks, and storage facility, and wherein players compete to be the first to assemble the building blocks into a predetermined structure on his own gameboard.

Still a further object of the present invention is to provide a game utilizing a set of building blocks for each player, wherein the set comprises three groups of building blocks each group having a unique configuration of building blocks, and wherein all the blocks interfit to form a predetermined polyhedron structure.

Another object of the present invention is to provide a game wherein players compete to be the first to interfit sets of building blocks on a gameboard in order to assemble a predesired polyhedron structure.

Yet a further object of the present invention is to provide a game having a gameboard for each player, wherein the gameboard also serves as the cover to a storage box, and wherein the building blocks and other playing pieces are stored within the storage box.

Briefly, the present invention provides a game for a plurality of players which comprises a gameboard for each player. Each gameboard includes a receptacle for receiving one face of a polyhedron structure. A set of building blocks is also provided for each player. The building blocks interfit to form the polyhedron structure on the gameboard. Chance determining means are also provided for determining the number of building blocks which each player can assemble during his own turn.

In an embodiment of the invention, the polyhedron structure is a regular pyramid having a square base. The base of the pyramid fits on the gameboard and is retained in the receptacle. Each set of building blocks comprises three groups of blocks. The blocks of the first group have a shape whereby, when positioned in the receptacle on the gameboard, each block provides a four faced regular pyramid extending upwardly from the gameboard. The blocks of the second group are each of the shape of a symmetric octahedron having a bifurcated lateral edge which define a pair of angularly oriented faces that extend to the central vertex. The blocks of each of the third group are in the shape of a four faced oblique pyramid having a parallelogram base.

By providing each set of blocks to include 16 blocks of the first group, 16 blocks of the second group, and 24 blocks of the third group, the blocks can interfit to form the regular pyramid structure. The blocks of the first group form the base tier, the blocks of the second group are positioned with their bifurcated end facing upwardly and form the second and third tiers, and the blocks of the third group form most of the outer surface of the regular pyramid as well as forming the top tier.

The aforementioned objects, features and advantages of the invention will, in part, be pointed out with particularity and will, in part, become obvious from the following more detailed description of the invention, taken in conjunction with the accompanying drawings, which form an integral part thereof.

BRIEF DESCRIPTION OF THE DRAWINGS

In the drawings:

FIG. 1 is an isometric view of a group of players in the midst of playing the game of the present invention;

FIG. 2 is an isometric view of a storage box and the gameboard of the present invention;

FIG. 3 is a side section view taken along line 3—3 of FIG. 2 and showing the storage box which retain the building blocks, and the gameboard lid;

FIG. 4 is an isometric view of the completed polyhedron structure on the gameboard, in accordance with the present invention;

FIG. 5 is a fragmentary sectional view taken along line 5—5 of FIG. 4 and showing part of the interfitting building blocks forming the polyhedron structure;

FIG. 6 is a fragmentary sectional view taken along line 6—6 of FIG. 4 and also showing the interfitting building blocks forming part of the polyhedron structure;

In the various figures of the drawing, like reference characters designate like parts.

DESCRIPTION OF THE PREFERRED EMBODIMENT

Figures 7, 8, 9, 10, 11, 12:
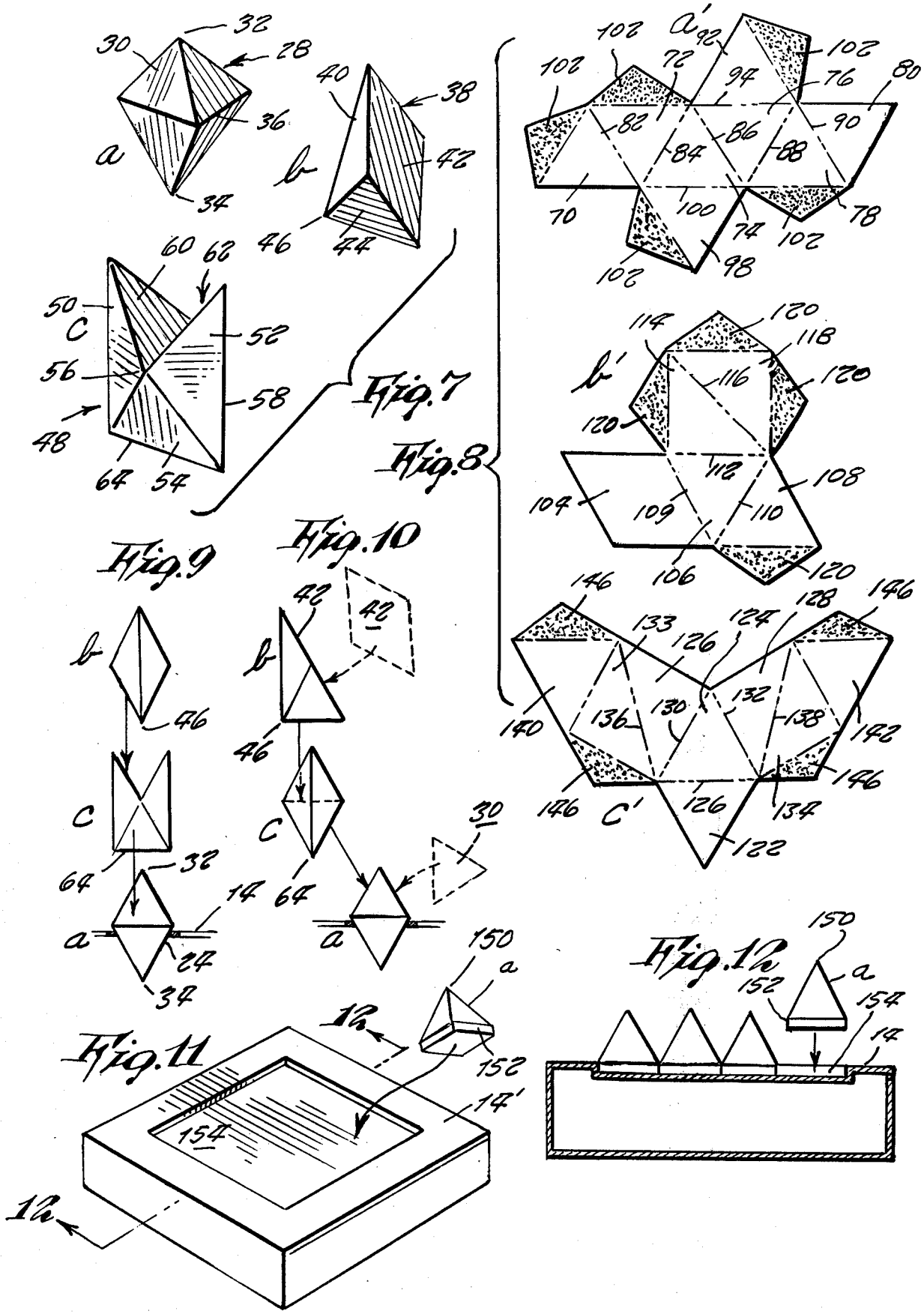
FIG. 7 is an isometric view of the three shapes of the building blocks utilized in the present invention.
FIG. 8 shows blanks which can be utilized in forming each of the three building blocks of the present invention.
FIG. 9 is an exploded view showing the interfitting of three building blocks in assembling one part of the polyhedron structure of the present invention.
FIG. 10 is an exploded view showing the interfitting of the building blocks in forming another part of the polyhedron structure of the present invention.
FIG. 11 is an isometric view of a modified version of the gameboard of the present invention.
FIG. 12 is a side sectional view taken along line 12—12 of the modified gameboard of FIG. 11.

The game of the present invention includes an individual gamebox 10 for each player, as shown in FIG. 1. The game could be played by two or more players and each has his own gamebox. The gamebox includes a storage box 12 having a cover or lid 14 which serves as the gameboard, and a plurality of playing pieces 16, to be hereinafter described, which are assembled to form a polyhedron structure, shown as the regular pyramid 18. The structure is formed directly on the gameboard and is retained by receptacle means provided on the board, as will hereinafter be described.

A chance determining means, shown as the die 20, is utilized for determining the number of building blocks which each player can assemble during his turn. Some of the playing pieces or building blocks are retained by each player, while others are placed in a central pool, as will hereinafter be described in the course of the description of the playing rules.

As can best be seen in FIGS. 2 and 3, the gamebox is a substantially square storage box, and the gameboard 14 serves as the lid covering the storage box 12, as well as the actual gameboard for the game. The lid can be removed completely to gain access to the inside of the storage box or can be pivotally attached at 22 to lift up and provide access to the inside of the storage box. Within the storage box can be kept the individual building blocks 16 to be used by that particular player.

It will be noted, that there is a complete set of building blocks for each player, wherein that set is sufficient to build a polyhedron structure on the gameboard of that player. All of the building blocks for that particular polyhedron which will be built on that gameboard may be retained within the particular storage box under the gameboard. Furthermore, the different game boxes can be uniquely identified, whereby the building blocks within a particular game box will be distinguishingly identified from every other set of building blocks. By way of example, different colors can be utilized for the building blocks within each gamebox.

The playing board 14 comprises a grid of square openings 24 which are separated by ribs 26. The openings 24 are placed in a square array with four openings on either side.

Referring now to FIG. 7, it will be noted that a set of building blocks includes blocks of three different configurations. The first configuration 28 referred to as building block a, is a regular octahedron. This shape includes eight congruous triangular faces 30. The upper four faces are incident to the vertex 32 and the lower four faces are incident to the vertex 34 with the interconnection between the upper and lower four faces forming the lateral edges 36 at the outer periphery of the building block a. This shape will hereinafter be referred to as being a regular octahedron, in accordance with known mathematical terminology.

The second building block shape 38 is building block b, and is a four faced oblique pyramid. The pyramid includes a base 42 of parallelogram shape. Two triangular faces, 40, 44 are shown, and extend upwardly from the base. Two other triangular faces, not seen in this view, would be respectively the same as faces 40 and 44. The four faces extending upwardly from the base are all incident at the vertex 46. Because the altitude from the vertex 46 to the base does not occur at the center of the base 42, it is referred to as an oblique pyramid.

The third building block c starts out initially as an octahedron, but not a regular octahedron. The building block shape 48 is a symmetrical octahedron with the two portions on either side of the lateral periphery edge being symmetrical. For example, the two faces 50 and 52 are congruous, and initially face 54 and its otherwise equivalent face on the opposite side would also be congruous. The three faces are incident at the vertex 56. The lateral edges 58 form the periphery about the building block c, on the opposite side, not shown, there would be a symmetrical version of these three faces. One lateral edge of the shape is noted to be missing. The lateral edge is rather bifurcated or cleaved, to form a pair of angularly oriented faces 60, 62 which inwardly extend toward the vertex 56 on one side and the opposite vertex on the other side. The lower edge 64 serves as the bottom of this building block.

Within each set of building blocks, there are provided a sufficient number in order to be able to construct the polyhedron structure, of the game. Specifically, as shown in FIG. 4, the desired structure is that of a regular pyramid having a square base which is positioned on the gameboard, and includes four congruous triangular faces 66 which meet a common vertex 68. In order to assemble this configuration, there is provided 16 blocks of the type a, 24 blocks of the type b and 16 blocks of the type c. The blocks are all put together to complete the pyramid construction of FIG. 4.

In assembling the blocks, the blocks a are placed into the openings 24 provided in the gameboard. It will be noted that the size of the opening 24 in the gameboard is less than the maximum lateral edge 36 of the periphery of the blocks a, whereby when a block a is inserted with one of its vertexes into the opening 24, the opening will hold the block a and prevent it from falling into the box.

The building blocks a will fit into the array of openings 24. It will be noted that 16 openings are provided to correspond to the 16 blocks a whereby these blocks complete a first tier at the bottom of the pyramid structure. This is shown in FIG. 6 where each of the building blocks a are shown to be positioned within the openings 24 in the playing board 14.

The second tier is provided by inserting the bottom end 64 of the building blocks c within the space defined by adjacent blocks a. The building blocks c are inserted with their bifurcated ends facing upwardly and are placed inwardly of the blocks a, as shown in FIG. 6. Twelve of the building blocks c will form a complete second tier, and additional four building blocks c placed in between adjacent blocks c of the second tier to form the third tier.

Finally, building blocks b are inserted with the vertex 46 placed internally of the structure and with the base 42 facing outwardly. The building blocks b will then form the outer peripheral surface of the entire structure, with the exception of the bottom layer which contains the a blocks. The b blocks also fit on top of the third tier of c blocks to form the upper most, fourth tier at the top of the pyramid structure.

The assembly of the blocks can be appreciated with regard to FIGS. 9 and 10. In FIG. 9 it will be noted that block a is inserted into the gameboard 14 through the opening 24 whereby one of its vertices 34 is inserted within the opening 24 while the other vertex 32 extends upwardly therefrom. It will be noted that the size of the opening 24 is such that it restrains the building block a from falling through the opening. As a result, the four faces of each building block a will extend upwardly from the gameboard 14.

The block c is then inserted between adjacent blocks a with its lower edge 64 facing downward and its bifurcated edge facing upwardly. Finally, the building block b is inserted within the bifurcated portion of building blocks c with its vertex 46 located at the bottom. A side view of the same interfitting can be noted in FIG. 10 with again the building block c fitting adjacent building block a and building block b fitting within the bifurcated portion of building block c. In this manner the base 42 forms the peripheral surface of the regular pyramid structure in its assembled form.

Although blocks a, b, and c could be made solid and could be formed of any suitable material such as wood, plastic, etc., in an embodiment of the invention these pieces are formed of stiff cardboard and are made of a patterned blank. The blanks useful for making these pieces are shown in FIG. 8. It is to be understood that these blanks are only shown in order to facilitate understanding of the shapes of the configurations and other blanks could be utilized as well in order to form these configurations. The blank shown generally at a' in FIG. 8 is useful for forming the regular octahedron block a heretofore described and shown in FIG. 7. The blank includes a series of adjacent equilateral triangles 70, 72, 74, 76, 78, and 80, each inverted with respect to its adjacent two triangles. The triangular sections are interconnected by means of fold lines 82, 84, 86, 88 and 90. Additionally, there is provided a further triangular section 92 along a common fold line 94 with the triangular section 76, and a final triangular section 98 interconnected by means of the common fold line 100 with triangle 74. Triangular glue surfaces 102 respectively extend from the triangular sections 70, 72, 78, 92 and 98. When folded together, the blank forms the regular octahedron a shown in FIG. 7.

The four faced oblique pyramid shown as block b in FIG. 7 can be formed from the blank b' shown in FIG. 8. This blank includes the equilateral parallelogram 104 which ultimately forms the base of the building block. Extending therefrom across fold line 109 are triangular sections 106 and 108 being inverted with respect to each other and interconnected by means of a common fold line 110. Sharing fold line 112 with triangular section 106 is a further triangular section 114 which shares a common fold line 116 with a final triangular section 118. Glue surfaces 120 extend from the triangular sections 108 and 114 with two glue sections extending from the outer two sides of the triangular section 118. When folded together the blank shown as b' will form the block b shown in FIG. 7.

The section c shown in FIG. 7 as the symmetrical octahedron having a bifurcated lateral edge, is formed from the blank c' shown in FIG. 8. The blank is noted to to be symmetrical and contains a lowermost triangular section 122 interconnected to a symmetrically opposite triangular section 124 along a common fold line 126. On either side of the triangular section 124 are larger triangular sections 126 and 128, respectively sharing the fold lines 130 and 132 with section 124. These sections respectively have diagonally opposed triangular sections 133 and 134, and respectively share the fold lines 136 and 138. In turn, sections 133 and 134 have final adjacent triangular sections 140 and 142, respectively. Glue surfaces 146 are provided adjacent the triangular sections 140, 142, 133, 134. When folded together the blank shown at c' in FIG. 8 will form the structure shown as c in FIG. 7.

Although the building blocks a have heretofore been shown as a regular octahedron, referring now to FIGS. 11 and 12, there will be shown an alternate embodiment wherein building blocks a can comprise a simple regular four sided pyramid having a square base with equal faces meeting in a common vertex 150. Extending downwardly from the base is a lower cubic section 152 serving as a support.

In FIGS. 11 and 12, the gameboard 14' is shown to have a single recess 154 formed therein. The recess 154 is large enough to accommodate an array of 16 building blocks a of the type shown in FIG. 11, with four on either side, as shown in FIG. 12. In this embodiment, rather than have each of the building blocks a individually supported by a receptacle, the blocks are placed adjacent to each other and the entire array is supported within the recess 154. The support section 152 on each building block a is made approximately equal to the depth of the recess 154 whereby only the angular four faces of the blocks a will be protruding upward from the gameboard.

Although the game heretofore described showed the formation of a regular pyramid having a square base as the ultimate structure to be formed, it will be understood that other types of structures could be formed using other shapes of building blocks. Accordingly other types of polyhedron structures could be formed utilizing other sets of building blocks. However, the unique arrangement of the three types of building blocks heretofore described to form the regular pyramid having a square base has been found to be uniquely beneficial and entertaining in providing an improved game.

The object of the game is for a player to be the first one to complete the building of his pyramid. Each player is provided with his own pyramid set including his game box and the pieces necessary to build his pyramid. Where a number of players are playing the game, each will have his own gamebox and each gamebox will contain different colored blocks such as red, blue, yellow and green. The gamebox cover serves as the playing board while the box serves as the storage for the blocks. Each box contains 16 blocks a referred to as the base blocks, 24 blocks b referred to as the boat blocks, and 16 blocks c referred to as bishop hats. The bishop hats are all interior blocks and the boats are all facing blocks. The base blocks are placed in the spaces provided on the playing board.

RULES OF THE GAME

1. Each player takes a box and removes all the blocks therefrom, and places half the blocks (8 base blocks, 8 bishop hats and 12 boats) in a pile near his box. Each player then places the remainder of his blocks in a common pile called the "pool".

2. A die is thrown by each player in clockwise order and the player with the highest number begins.

3. The die is thrown by the first player. If the number 1 is thrown, one block is placed on the board and the player gets an extra turn. If the number 2 is thrown, a player may place two blocks in the pyramid or take 2 points worth of blocks from the other players. If a 3 or 4 is thrown, that number of blocks from the player's pile are placed on the board. Blocks may be placed in any order, but none of the four "boats" forming the top of the pyramid may be placed until all of the other blocks are in place. The outside facing blocks must be of a certain color, as follows:

| No. of players | Base Tier | Second Tier | Third Tier | Top Tier |
|---|---|---|---|---|
| 2 | Players own Color | Other players Color | Players own Color | Other players Color |
| 3 | " | Color of player on right | " | Color of player on left |
| 4 | " | " | Color of opposite player | " |

Interior blocks may be of any color, but base blocks must be all the same color. For the purpose of taking blocks from other players or the pool, each point of the die thrown is worth 1 boat, or 1 base block, or 2 bishop's hats.

4. If the number 5 is thrown, the die is thrown again. The player then takes from the pool the number of blocks equal to the die points received on the second throw. The player then throws again and if the number 1 through 5 is thrown, that number of blocks are placed in the pyramid. A player does not get an extra turn if 1 is thrown in this situation. If a six is thrown, it does not count for blocks and the play moves on to the next player immediately. (This rule does not apply to a six thrown in regular play).

5. If a six is thrown in regular play, each other player takes in turn from the pool or from the pile of the player throwing the six, one points worth of blocks. Players may take blocks only in clockwise order.

6. If a person has no blocks when his turn comes up, he may take two points worth of blocks from the pool or take his turn to try to roll a 5. If the pool has no blocks, the player with no blocks may take from the other players a total of two points worth of blocks; providing no player that had blocks is left with less than one block. Up to four blocks may be traded between players but only before a turn is taken by any of the trading players. For the purpose of trading with another player or with the pool, two bishop's hats are worth one base block or one boat, and a boat and base block have equal value. There is no loss of turn for trading between players.

7. (BLOCK BONUSES) The first player to complete an X on his board with base blocks, forming a straight line between corners of the playing board, may take four points worth of blocks from the pool. The first player to finish placing the first tier of boats may take three points worth of blocks from the pool. The first player to finish placing the second tier of boats may take two points worth of blocks from the pool. Bonus blocks are not taken until all blocks equal to the die points thrown are placed.

8. A player may trade blocks from his pile with blocks of the same value from the pool when his turn comes, but he loses his turn.

9. If the pool runs out of blocks, a player's right to take blocks from the pool applies to the blocks in the piles of all other players, except to trade and after a six is thrown. A further exception is that if the pool runs out of blocks, a player with no blocks who choses to take two points worth of blocks from the other players may not leave any of the players with less than one block.

10. Once a block is placed in a pyramid it cannot be moved or removed.

11. No block may be placed in a higher tier if it could be placed in a lower tier.

12. The pyramid may be completed only by placing the exact number of blocks equal to the number of the die thrown.

Although a single die has been utilized to provide a chance determining means, it will be understood that other types of chance determining means, such as a spinner, wheel, etc., could be utilized to provide such chance determining means.

There has been disclosed heretofore the best embodiment of the invention presently contemplated. However, it is to be understood that various changes and modifications may be made thereto without departing from the spirit of the invention.

I claim:

1. A game for a plurality of players, comprising a gameboard for each player, each gameboard including receptacle means for receiving one face of a polyhedron structure, a set of building blocks for each player, the blocks interfitting to form said polyhedron structure on the gameboard, said polyhedron structure being a regular pyramid having a square base, the base of said pyramid fitting into the gameboard and being retained in said receptacle means, each set of said building blocks comprising three groups of geometrically shaped blocks, which groups of blocks symmetrically interfit to form said regular pyramid, and wherein each block of said first group of blocks has a shape whereby when positioned in said receptable means a four faced regular pyramid extends upwardly from said gameboard for each block; each block of said second group of blocks is in the shape of a symmetrical octahedron having a bifurcated lateral edge defining a pair of angularly oriented faces that extend to the vertex; and each block of said third group of blocks is in the shape of a four faced oblique pyramid having a parallelogram shaped base.

2. A game as in claim 1 and wherein each set of blocks comprise 16 blocks of said first group, 16 blocks of said second group, and 24 blocks of said third group.

3. A game as in claim 2 and wherein, when assembled into said polyhedron structure, said blocks of said first group form the base tier, said blocks of said second group are positioned with their bifurcated ends facing upwardly and form a second and third tier, and the blocks of said third group form the substantial part of the outer surface of the entire polyhedron structure, as well as the top tier.

4. A game as in claim 1 and wherein each block of said first group of blocks has the shape of a regular octahedron, and wherein said receptacle means comprises a uniform rectangular grid of square openings, the size of each opening being less than the size of said regular octahedron building blocks, whereby each opening receives and retains a respective one of the building blocks of said first group.

5. A game as in claim 1 and wherein each block of said first group of blocks has the shape of a four faced regular pyramid having a square base, and a cubic support member extending from said square base, and wherein said receptacle means comprises a square recess the side of which is substantially equal to a square array formed by the blocks of said first group each positioned on its respective support member.

6. A game as in claim 1 and further comprising a storage box for each player for receiving therein the associated set of building blocks forming the polyhedron structure, the gameboard for that player serving as the lid of the storage box.

7. The game as in claim 1 wherein each set of building blocks is distinguishingly identified from every other set of building blocks, and chance determining means for determining the number of building blocks which each player can assemble during his turn.

* * * * *